United States Patent [19]

Reemelin

[11] 3,956,781

[45] May 18, 1976

[54] COLLAPSIBLE COT ASSEMBLY

[76] Inventor: Otto M. Reemelin, 2336 W. Keim, Phoenix, Ariz. 85015

[22] Filed: Dec. 16, 1974

[21] Appl. No.: 532,816

[52] U.S. Cl. ..... 5/114; 5/82 R; 5/110

[51] Int. Cl.[2] ..... A47F 1/00

[58] Field of Search ..... 5/82, 110, 111, 113, 5/114; 248/188, 188.1

[56] References Cited

UNITED STATES PATENTS

| | | | |
|---|---|---|---|
| 2,973,888 | 7/1961 | Beardsley | 5/114 |
| 3,134,987 | 6/1964 | Bertram | 5/114 |
| 3,417,412 | 12/1968 | Andrews | 5/114 |
| 3,426,367 | 2/1969 | Bradford | 5/82 |

*Primary Examiner*—Casmir A. Nunberg

*Attorney, Agent, or Firm*—Cahill, Sutton & Thomas

[57] ABSTRACT

A collapsible cot is disclosed which is compact when disassembled and is readily assembled to form a structurally stable assembly. The main components of the assembly are joined by quick assembling pin connectors.

7 Claims, 7 Drawing Figures

COLLAPSIBLE COT ASSEMBLY

FIELD OF THE INVENTION

This invention relates generally to a collapsible cot assembly and, more particularly, to such an assembly that is rapidly assembled.

BACKGROUND OF THE INVENTION

In all applications for a collapsible cot, and particularly when used for back packing and camping, compactness is a significant advantage. The applications for collapsible cots are numerous but are particularly adapted to those situations in which space is at a premium. For instance, the load which can be carried on the back of a camper is restricted not only in weight but in size. Therefore it can be readily seen that the more compact a disassembled collapsible cot becomes, the more advantageous it becomes to the user.

Various attempts have been made to reduce the size of the elements comprising the cot assembly when they are disassembled. At least as early as 1912, H. Mattes in his U.S. Pat. No. 1,020,998, disclosed a cot whose side rails were assembled from several lengths of pipe. While the pipe sections could be disassembled and the entire cot broken down into component parts, the disassembled package was still a relatively bulky unit.

In U.S. Pat. No. 1,944,064, M. J. Byer disclosed a folding cot including bow-shaped leg supports which fold upon themselves to form a relatively linear package. The side rails of the cot are hinged to fold in half when the unit is disassembled. The bow-shaped supports slide into sockets attached to the side rails. No actual connection between the bow-shaped support and the side rails occurs. The side rails merely rest upon the ends of the bow-shaped supports. Even when fully disassembled, this package is relatively large and the lack of positive connection between the supports and the supporting side rails diminishes the stability of the unit.

A convertible camp cot was disclosed in U.S. Pat. No. 2,973,888 which issued in 1961 to H. H. Beardsley. While this device provides more positive connection between the bow-shaped support legs and the side rails, the bow-shaped legs are rigid, resulting in a bulky package when disassembled.

A similar compact cot was disclosed in the 1964 U.S. Pat. No. 3,134,987, issued to W. H. Bertram. Once again, the disassembled package of this assembly is a bulky one since the bow-shaped support legs do not disassemble. This assembly also suffers from the instability discussed earlier since the side rails fit either over the ends of the bow-shaped support legs to be supported by the heads of a rivet positioned through the end of each support leg, or else the end of the support leg rests against a portion of the hinge mechanism comprising part of the side rails of the cot.

Therefore, it is an object of my invention to provide a collapsible cot which can be rapidly assembled.

It another object of my invention to provide a readily disassembleable cot which becomes a mechanically stable structure when fully assembled, due to substantial mechanical connection between all parts of the assembly.

Yet another object of my invention is to provide a collapsible cot assembly which disassembles to form a small package.

It is still a further object of my invention to provide a collapsible cot which can be assembled without the use of tools.

SUMMARY OF THE INVENTION

In accordance with the present invention, a collapsible cot assembly is provided which forms a small, lightweight package when disassembled. The cot is readily and rapidly assembled by hand to form a structurally stable assembly. Major components of the assembly join together with quick assembling pin connectors.

DETAILED DESCRIPTION OF THE ILLUSTRATIVE EMBODIMENT

Figure 1:
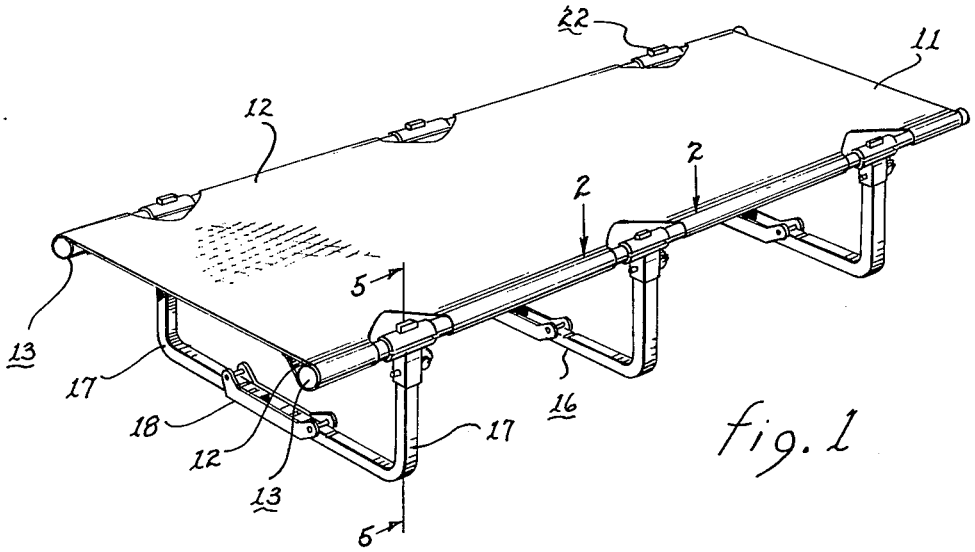
FIG. 1 is a perspective view of a cot embodying my invention.

In FIG. 1, a body supporting flexible sheet 11 having a generally rectangular configuration is shown. Each of the longer sides of the rectangular configuration are folded back on themselves and stitched to form an envelope 12 at each side of sheet 11. Into each of the envelopes 12 is inserted a side rail assembly 13. The side rail assemblies 13 act to support and stretch sheet 11. A plurality of support leg assemblies 16, each comprising a pair of support leg ends 17 and an interconnecting central link 18, connect to the side rails 13 at joint assembly 22. Support leg assembly 16 acts to hold sheet 11 tightly stretched while supporting the side rail assemblies 13 and sheet 11 a desired distance off the ground or floor.

Figure 2:
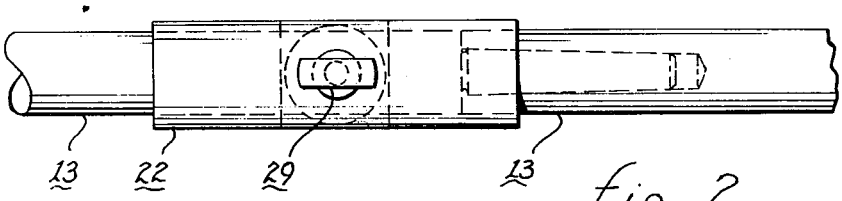
FIG. 2 is a partial plan view taken in the direction indicated in FIG. 1.
Figure 3:
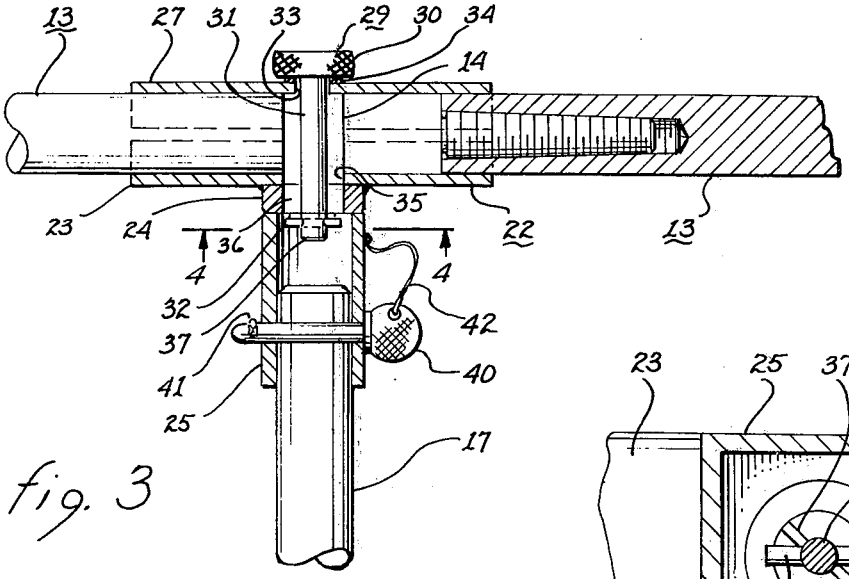
FIG. 3 is a partial elevation, shown partially in cross-section, of the apparatus of FIG. 2.
Figure 4:
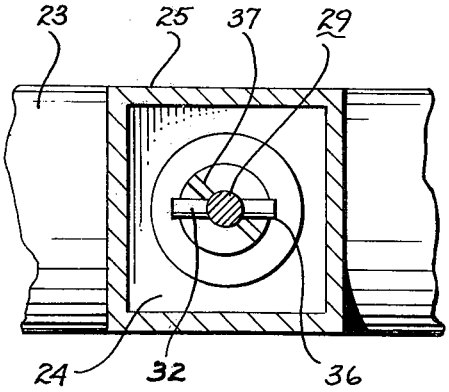
FIG. 4 is a plan view taken in cross-section as shown in FIG. 3.

Details of joint assembly 22 are shown in FIGS. 2, 3 and 4. FIG. 2 shows a plan view of a side rail assembly 13 and a joint assembly 22 which are locked together in a mechanically stable assembly by locking pin assembly 29. The joint assembly shown in FIG. 2 is depicted in a partial cross-sectional elevational view shown in FIG. 3.

As can be seen in FIG. 3, joint assembly 22 includes a bottom support saddle 23 which has a shape conforming generally to that of a length of tubing cut in half along its longitudinal axis to provide a generally semicircular cross-section. Support saddle 23 is positioned with the open side of the semicircular configuration upward to support a side rail assembly 13. Attached to the saddle support 23 is a locking insert 24 and an adapter 25. A joint cap 27 is shaped similarly to support saddle 23 but positioned over top of side rail assembly 13.

A locking pin assembly 29 connects joint assembly 22 to side rail assembly 13. Locking pin assembly 29 comprises a knurled turret 30 connected to one end of pin shank 31 which has a lock bar 32 extending through it at right angles to its length and located at the opposite end of the pin shank 31. Locking pin assembly 29 is positioned through hole 33 in joint cap 27 and supported by a support washer 34. Locking pin assembly 29 is then inserted through the side rail assembly 13 via an insert slot 35 therein. As can be seen clearly in FIG. 4, which shows a plan view of locking insert 24, the locking pin assembly 29 is inserted through locking insert 24 via locking slot 36. Once pin assembly 29 is inserted through locking slot 36, knurled turret 30 is twisted, causing pin shank 31 to rotate. This in turn causes locking bar 32 to rotate out of the plane of slot 36 and into a force fit position with a locking projection 37 extending from the surface of locking insert 24.

Support leg end 17 is inserted into the open end of adapter 25. An aligned hole extends through adapter 25 and leg end 17 into which assembly pin 40 may be inserted. A spring loaded latch projection 41 appears at the insertion end of pin 40 and is adapted to secure pin 40 into the through hole. Pin 40 is attached to adapter 25 with a flexible attachment link 42 to prevent the inadvertent loss of pin 40 when this unit is disassembled.

Figure 5:
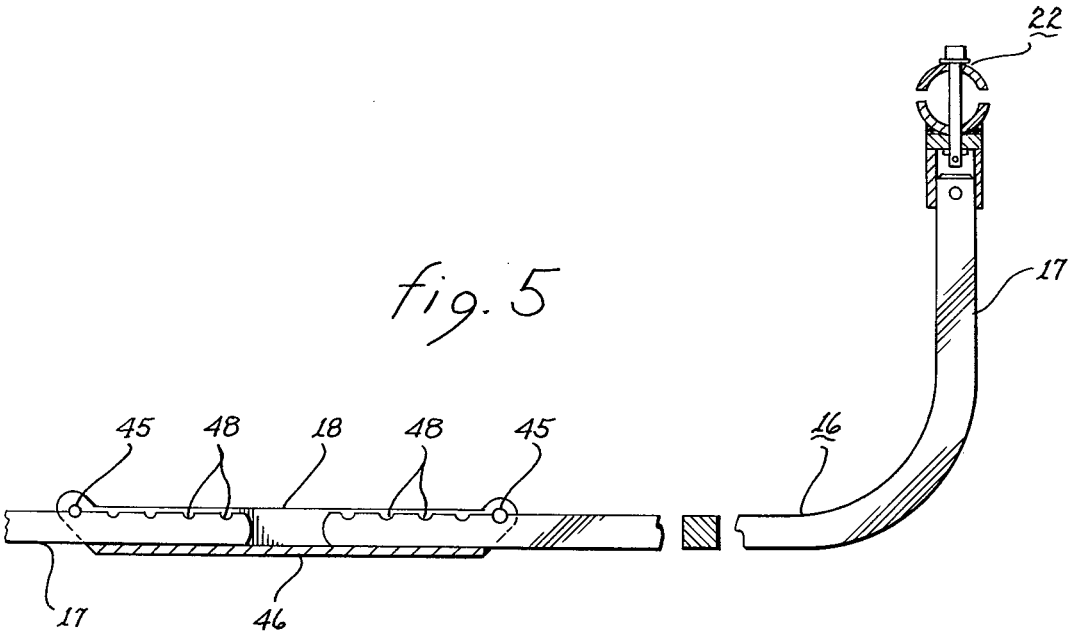
FIG. 5 is an elevation view, taken partially in cross-section, along the lines shown in FIG. 1.

An enlarged view of the support leg assembly 16 is shown in FIG. 5. One end of support leg end 17 is inserted into joint assembly 22 as previously described. The other end of support leg 17 connects to central link 18, which also connects to the other leg end 17 comprising the pair, as follow: leg end 17 has a bend of approximately 90° at its mid-span. The end which connects to link 18 has a series of adjustment notches 48 which run across its length at the top surface thereof. Central link 18 includes a pivot pin 45 at either end thereof and a bottom plate 46. The end of leg end 17 is inserted into link 18 between pivot pin 45 and bottom plate 46. Pin 45 is positioned in the desired adjustment notch 48. When support leg 17 is rotated about pivot pin 45 until its end contacts bottom plate 46, a rigid and mechanically stable assembly results. Leg end 17 is provided with a plurality of the adjustment notches 48 to permit some adjustment to be made in the width of support leg assembly 16. This ensures sufficient distance between side rail assemblies 13 to ensure that body supporting sheet 11 will be taut.

Figure 6:
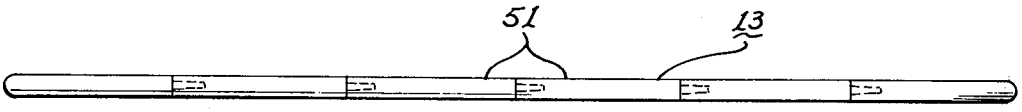
FIG. 6 is an elevation view of a side rail fabricated from a number of sections and embodying my invention.
Figure 7:
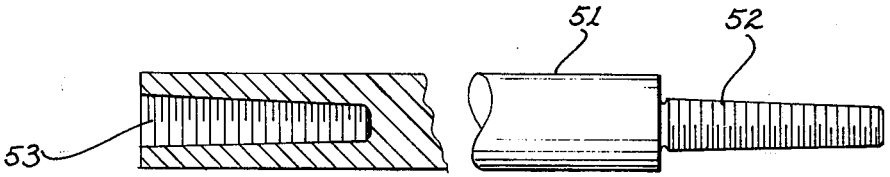
FIG. 7 is an enlarged elevation, partially in cross-section, showing one section of the side rail shown in FIG. 6.

FIGS. 6 and 7 show the elements comprising the side rail assembly 13. Rail 13 comprises a number of individual rail segments 51. FIG. 7 shows a typical segment 51 which includes a threaded extension 52 and a threaded receptacle 53. Two rail segments 51 could be assembled by screwing the threaded extension 52 of one such segment into the threaded receptacle 53 of another such segment. Naturally the end segments comprising rail assembly 13 would differ somewhat from segment 51 since they would only include either a threaded extension 52 or a threaded receptacle 53 as required.

Although side rail 13 has been shown as having a circular cross-section and leg end 17 has been shown having a square cross-section, it should be understood that this is for illustrative purposes only. It should be understood that leg end 17 and its associated adapter 25 of joint assembly 22, and side rail assembly 13 and saddle 23 and joint cap 27 of joint assembly 22 could have any convenient cross-sectional configuration including that of a polygon, oblong, etc. Further, leg end 17, and rail segment 51 between the threaded extension 52 and threaded receptacle 53 could be fabricated from hollow tubing and need not be solid as shown.

Many other variations from those of the embodiment described could be made by those skilled in the art without departing from the spirit and scope of my claimed invention.

What I claim is:

1. An apparatus for a collapsible cot having sheet means for supporting a load; rail means for holding said sheet means; a plurality of leg means for positioning said rail means a predetermined distance above a floor; joint means for interconnecting said leg means and said rail means; and wherein the improvement comprises:

a plurality of insertable pin means extending through said leg means for locking said joint means to said leg means and extending through said rail means for locking said joint means to said rail means, thereby forming a stable structure.

2. Apparatus for a collapsible cot comprising, in combination:

a. sheet means for supporting a load;
b. rail means for holding said sheet means;
c. a plurality of leg means for positioning said rail means a predetermined distance above a floor;
d. joint means for interconnecting said leg means and said rail means; and
e. a plurality of insertable pin means extending through said leg means for locking said joint means to said leg means and extending through said rail means for locking said joint means to said rail means, thereby forming a stable structure.

3. Apparatus in accordance with claim 2 wherein said sheet means includes a. a flexible sheet having a generally rectangular configuration; and
b. a pair of enclosing envelopes forming the long sides of said rectangular sheet for receiving said rail means; and wherein said rail means includes
   a pair of rod-shaped rails for insertion into the enclosing envelopes, each said rail having a plurality of rod-shaped modules having an externally threaded portion at one end thereof and an internally threaded portion at the other end thereof; opposite ends of two such modules being threadably connectable.

4. Apparatus for a collapsible cot comprising, in combination:

a. sheet means for supporting a load, said sheet means including
   1. a flexible sheet having a generally rectangular configuration; and
   2. a pair of enclosing envelopes forming the long sides of said rectangular sheet for receiving said rail means;
b. rail means for holding said sheet means, said rail means including a pair of rod-shaped rails for insertion into the enclosing envelopes, each said rail having a plurality of rod-shaped modules having an externally threaded portion at one end thereof and an internally threaded portion at the other end thereof, opposite ends of two such modules being threadably connectable;
c. a plurality of leg means for positioning said rail means a predetermined distance above a floor, each said leg means including
   1. a pair of corner pieces, each having
      i. a rod-shaped element including a first end and a second end;
      ii. a plurality of adjustment notches positioned at an edge of said first end and across the axis of the element; and iii. a segment connected at a substantial angle to said second end and being adapted at an upper end thereof for connecting to said joint means; and 2. a central interconnecting link for attaching to said pair of corner pieces, said link having i. a long U-shaped piece including a pair of upright arms and a flange connecting the arms; and ii. a pair of pivot pins located at opposite ends of said link and connecting between said upright arms at a distance from said flange for engaging the adjustment notches;

whereby, said link attaches to said corner pieces by inserting said first ends thereof into opposite ends of said link between said pivot pins and said flange, engaging one of the adjustment notches in said first ends, and positioning said first ends against said flange;

d. joint means for interconnecting said leg means and said rail means; and e. a plurality of insertable pin means for locking said joint means to said leg means and for locking said joint means to said rail means, thereby forming a stable structure.

5. Apparatus in accordance with claim 4 wherein each said joint means includes a. a bottom saddle for supporting one of said rails, said saddle having 1. a generally concave cross-section with the concavity positioned upwards; and 2. a through hole;

b. a top cap for retaining one of said side rails, said cap having a generally concave cross-section with the concavity positioned downwards;

c. a locking insert attached to the bottom of said saddle and having an aperture therein aligned with the through hole; and d. an adapter attached to said saddle and having a hollow portion into which said upper end may be inserted.

6. Apparatus in accordance with claim 5 wherein said pin means includes a. a plurality of first pin means for securing said leg means to said joint means by inserting one of said first pin means through one of said adapters and said inserted upper end; and b. a plurality of second pin means, each for securing said rail means to said joint means and having:

1. a turret;

2. a pin attached at one end to said turret; and 3. a bar protruding from the other end of said pin and substantially perpendicular thereto;

whereby, said rail means is secured to said joint means by inserting one of said second means through said top cap, said rail, the through hole and the aligned aperture and then rotating the turret to force the bar to contact said locking insert.

7. Apparatus for a collapsible cot comprising, in combination:

a. a flexible sheet means for supporting a load and having a generally rectangular shape, the long sides of the rectangle being folded back on themselves and fastened together to form a pair of enclosing envelopes;

b. a pair of side rails insertable into the enclosing envelopes for holding said sheet means taut between said rails, each of said rails including a plurality of rod shaped sections which are threadably connectable to each other;

c. a pair of corner pieces, each having 1. a rod shaped element including a first end and a second end;

2. a plurality of adjustment notches positioned at an edge of said first end and across the axis of the element; and 3. a segment connected at a substantial angle to said second end and being adapted at an upper end thereof for connecting to said joint means;

d. a central interconnecting link for attaching to said pair of corner pieces, said link having 1. a long U-shaped piece having a pair of upright arms and a flange connecting the arms; and 2. a pair of pivot pins located at opposite ends of said link and connecting between said upright arms at a distance from said flange for engaging the adjustment notches;

whereby, said link attaches to said corner pieces by inserting said first ends thereof into opposite ends of said link between said pivot pins and said flange, engaging one of the adjustment notches in said first ends, and positioning said first ends against said flange;

e. a plurality of joint means for mounting said side rail means to said leg means, each joint means including 1. a bottom saddle having a concave shape positioned upward for supporting said side rail means and having a through hole therein;

2. a locking insert attached to the bottom of said saddle and having an aperture therein aligned with the through hole;

3. an adapter attached to the bottom of said saddle and having a hollow portion into which said upper end may be inserted; and 4. a top cap having a concave shape positioned downward for retaining said side rail means;

f. a plurality of first pin means, each insertable through said adapter and said inserted upper end, for securing said leg means to said joint means; and g. a plurality of second pin means insertable through said top cap, said side rail means, said through hole and said aligned aperture for securing said side rail means to said joint means.

* * * * *